US007717664B2

(12) United States Patent
Bitter et al.

(10) Patent No.: US 7,717,664 B2
(45) Date of Patent: May 18, 2010

(54) LOADER

(75) Inventors: Marcus Bitter, Mannheim (DE); Richard Tudor, Zweibrücken (DE)

(73) Assignee: Deere & Company, Moline, IL (US)

( * ) Notice: Subject to any disclaimer, the term of this patent is extended or adjusted under 35 U.S.C. 154(b) by 169 days.

(21) Appl. No.: 11/851,034

(22) Filed: Sep. 6, 2007

(65) Prior Publication Data

US 2008/0063501 A1 Mar. 13, 2008

(30) Foreign Application Priority Data

Sep. 8, 2006 (DE) ..... 10 2006 042 370

(51) Int. Cl.
*B66C 13/12* (2006.01)

(52) U.S. Cl. ..... 414/699; 60/459; 60/463

(58) Field of Classification Search ..... 414/699, 414/680, 718, 728; 60/459, 463; 280/754
See application file for complete search history.

(56) References Cited

U.S. PATENT DOCUMENTS

| | | | | |
|---|---|---|---|---|
| 4,042,135 | A * | 8/1977 | Pugh et al. | 414/718 |
| 4,316,697 | A * | 2/1982 | Yokoyama | 414/694 |
| 2006/0218912 | A1 * | 10/2006 | Price et al. | 60/459 |

FOREIGN PATENT DOCUMENTS

| | | |
|---|---|---|
| DE | 198 53 523 | 3/2003 |
| EP | 1 612 184 | 1/2006 |
| JP | 05 202535 | 8/1993 |
| WO | WO 2004/007339 | 1/2004 |

OTHER PUBLICATIONS

European Search Report, May 14, 2009, 8 Pages.

* cited by examiner

*Primary Examiner*—Donald Underwood

(57) ABSTRACT

A loader includes a hydraulically operated extension arm, a load sensor for monitoring the load condition on the loader and a hydraulic arrangement for actuation of the extension arm and/or an implement attached to the extension arm. The hydraulic arrangement exhibits at least one hydraulic cylinder with one supply line on the piston rod side and one supply line on the piston side. At least one hydraulically switchable control device is coupled between a source of fluid pressure and a hydraulic tank, on the one hand, and the supply lines on the other hand. An actuating device is coupled for routing control pressure to the control device via first and second control pressure lines. An electronic control unit is connected for effecting operation of a control pressure control device, which is coupled to at least one of the control pressure lines, in response to a load signal received from the load sensor so as to actuate the control device for achieving a slowed-down actuation of the hydraulic cylinder in conjunction with the onset of a critical load condition. Thus, a restriction of a volumetric flow is achieved in at least one of the supply lines coupled to the hydraulic cylinder.

5 Claims, 4 Drawing Sheets

LOADER

FIELD OF THE INVENTION

The invention relates to a loader with a hydraulically actuated extension arm, a sensor for monitoring the load condition on the loader and a hydraulic arrangement for actuation of the extension arm and/or implement attached to the extension arm, the hydraulic arrangement exhibiting at least one hydraulic cylinder; at least one hydraulically actuated control device for controlling the at least one hydraulic cylinder, a hydro-mechanical actuating device for the generation of hydraulic control pressure signals for the at least one control device, a hydraulic source, a hydraulic tank and an electronic control unit.

BACKGROUND OF THE INVENTION

In the area of loaders, such as loading vehicles or telescopic loaders and the like, systems are previously disclosed which protect the vehicle from getting into an unsafe load condition. Unsafe load conditions arise, for example, when the vehicle overturns over the front axle as the result of a forward shift in the center of mass. In these systems, the hydraulic functions are braked and are brought to a halt as soon as a sensor detects that the vehicle is threatening to tip. Once the hydraulic actuators have been stopped, the only functions that can still be operated are those which bring the vehicle back into a safe condition, for example raising the extension arm, tilting back the implement or the load and retracting the extension arm.

In systems of this kind, it is sensible not to arrest the movements of an extension arm too abruptly, as this can lead to overturning of the vehicle due to the inertia of the load and the extension arm. It is sensible to slow down the functions progressively the closer the vehicle approaches to a critical operating condition or load condition.

WO 2004/007339 A1 discloses a system of this kind. Here a tipping moment acting on the vehicle is detected by a sensor and is transmitted to an electronic control unit. Also provided are a number of hydraulic cylinders for the lifting, lowering and telescoping of a telescopic extension arm as well as the electro-hydraulic actuation of the hydraulic cylinders. The system provides for the hydraulic functions for operating the hydraulic cylinders to be slowed down as a set threshold value for the tipping moment is approached, before the hydraulic cylinders come to a complete standstill. In this case, for example, the load signal is processed electronically and the possibilities for operation by the user are reduced and/or operation is prevented. The more advanced the technology, for example by the use of electronic control units, the easier is the intervention by means of the electronics.

For hydro-mechanical systems with mechanically controlled control devices, the characterizing features disclosed in WO 2004/007339 A1 do not find an application, because a hydraulically pilot-controlled system intervention is not possible in a controlled manner by such simple means in the functions, due to the absence of suitable electronics.

SUMMARY OF THE INVENTION

The underlying object of the invention is to propose a loader of the kind indicated by way of introduction, by which the aforementioned disadvantages are overcome.

According to the invention, a loader of the kind mentioned by way of introduction is configured in such a way that means for varying the control pressure are connected to at least one control pressure line running between the actuating device and the control device, by which means, depending on a sensor signal supplied by the sensor, the control pressure generated by the actuating device is capable of being varied. The operability of the hydraulically controlled control device is influenced via the means for varying the control pressure in such a way that the pressure in the control pressure line is reduced, so that the manipulating variable at the control device and thus the volumetric flow of hydraulic fluid for the hydraulic cylinder regulated via the control device is reduced. The control pressure in the control pressure line is reduced to an increasing extent in this way, the closer a critical value for the load condition is approached, which value is set by the electronic control unit. In order to prevent an operator from being able to bring the vehicle into an unsafe condition, which might ultimately result in the overturning of the vehicle, the functions of the hydraulic cylinder are initially slowed down in this way and are then finally brought completely to a halt.

The means for varying the control pressure preferably consists of at least one electro-hydraulic overpressure valve capable of being actuated by the electronic control unit. The electro-hydraulic overpressure valve can be opened progressively depending on the load signal supplied by the sensor and/or the overload signal. The closer one approaches to the pre-set threshold value, the greater is the threat of the vehicle overturning, and the less the overpressure valves are adjusted. On the basis of the resulting decreasing control pressure, the valve gate of the control device is deflected to a smaller extent, as a result of which the control devices send less volumetric flow to the hydraulic cylinder, which consequently comes to a halt increasingly slowly. The control device can be actuated as usual in the opposite direction of movement. It is naturally conceivable for a number of hydraulic cylinders to be arranged in the hydraulic arrangement, and thus for a number of control devices to be capable of being used for the control of the hydraulic cylinders by being hydraulically adjusted. In the event that a number of control devices and a number of hydraulic cylinders are used, a number of electro-hydraulic overpressure valves accordingly can be used, which are adjusted by the electronic control unit depending on the sensor signal.

In an alternate embodiment, the means for varying the control pressure comprises at least one electro-hydraulic pressure reduction valve capable of being actuated by the electronic control unit, which is arranged directly in a pressure control line for the valve gate of the control device. The electro-hydraulic pressure reduction valve can be actuated depending on the load signal supplied by the load sensor and/or the overload signal. The closer one approaches to the pre-set threshold value, the greater is the threat of the vehicle overturning, and the more the control pressure for the valve gate is throttled or reduced by the pressure reduction valve. On the basis of the resulting decreasing control pressure, the valve gate of the control device is deflected to a smaller extent, as a result of which the control devices send less volumetric flow to the hydraulic cylinder, which consequently comes to a halt increasingly slowly. The control device can be actuated in the opposite direction of movement from that which is customary. It is naturally also conceivable for a number of hydraulic cylinders to be arranged in the hydraulic arrangement, and thus for a number of control devices to be capable of being adjusted hydraulically for the control of the hydraulic cylinders. In the event that a number of control devices and a number of hydraulic cylinders are used, a number of electro-hydraulic pressure reduction valves can accordingly be used, which are adjusted by the electronic control unit depending on the sensor signal.

It is thus possible to restrict the movements of the extension arm in such a way that the vehicle is not able to get into a dangerous operating condition, in conjunction with which the operator, in addition to the warning signals which are generated anyway in the cab of the loader, will be made aware of the fact that, in spite of its adjustment default, the extension arm is moving increasingly slowly until it comes to a halt.

The hydro-mechanical actuating device is preferably configured as a joystick. Valves are actuated in this case by the corresponding mechanical deflection of a control lever, which valves are connected to the hydraulic source and the control pressure line and generate a control pressure for the control device of the hydraulic cylinder.

The loader is preferably configured as a telescopic loader, in conjunction with which the extension arm is capable of being varied via a first hydraulic cylinder in respect of its angle of attack and via a second hydraulic cylinder in respect of its length, in conjunction with which a third hydraulic cylinder may be provided, with which an implement arranged on the extension arm is capable of being caused to pivot. Thus, for example, the tilting back of a loading shovel filled with material can also lessen a critical load condition, but without the extension arm being moved. In any case, the overpressure valves or pressure reduction valves arranged in the control pressure lines of the control devices provide for a slow execution of the movements determined by the operating person, so that no disruptive inertia mass effects of the load material or of the extension arm occur, which can then provoke overturning of the loader in the vicinity of the threshold value range.

In another embodiment, the loader comprises a front loader, in which the extension arm is configured as the load arm of a front loader, which is capable of being varied via a first or a first and second hydraulic cylinder in respect of its angle of attack. A third hydraulic cylinder can be provided by means of which an implement provided on the extension arm, for example a loading shovel or a loading In another embodiment, the loader comprises a front loader, in which the extension arm is configured as the load arm of the front loader, which is capable of being varied via a first or a first and second hydraulic cylinder in respect of its angle of attack. A third hydraulic cylinder can be provided by means of which an implement provided on the extension arm, for example a loading shovel or a loading fork, is capable of being caused to pivot.

Of course, all other customary loading implements, for example buckets, bale grabbers, etc., are capable of being used both with the telescopic loader and with the loader equipped with the front loader.

The sensor is preferably configured and arranged in such a way that a critical load condition on the loader is detectable. The sensor can be arranged on an axle of the vehicle, for example, and can indicate a critical load condition in the event of a correspondingly high, unbalanced load. Strain gauges or force transducers, for example, can find an application in this case. It is also conceivable to position the sensor at some other suitable point and, for example, to define the inclination of a vehicle frame in relation to the vehicle axis as the critical load condition quantity.

The invention and further advantages and advantageous further developments and embodiments of the invention are described in more detail and explained below with reference to the drawing which depicts illustrative embodiments of the invention.

DESCRIPTION OF THE PREFERRED EMBODIMENT

Figure 1:
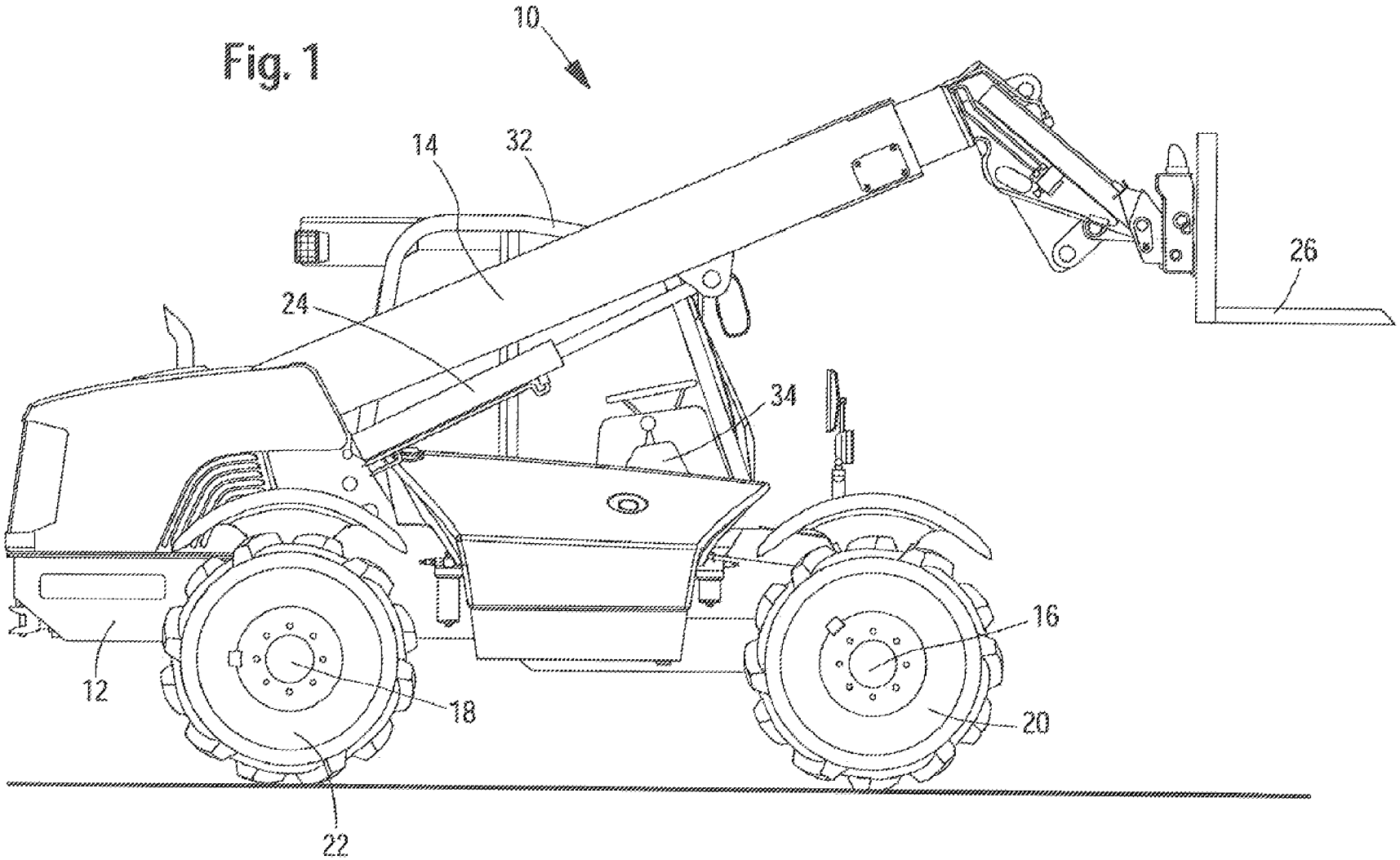
FIG. 1 is a schematic right side view of a loader configured as a telescopic loader having a hydraulic arrangement.

Illustrated in FIG. 1 is a loader 10 in the form of a telescopic loader. The telescopic loader 10 exhibits a frame 12, to which an extension arm 14 is linked The frame 12 is supported by a front axle 16 and by a rear axle 18 with corresponding front and rear sets of wheels 20 and 22, respectively.

The extension arm 14 is configured as a telescopic extension arm and is adjustably linked via a hydraulic cylinder 24 in respect of its angle of attack in relation to the frame 12. A second hydraulic cylinder (not illustrated) is arranged in the interior of the extension arm 14 and permits the retraction and/or extension (telescoping) of the extension arm. A third hydraulic cylinder (not illustrated) is arranged on the free end of the extension arm 14 in the interior and permits the oscillation and/or tilting of a loading implement 26.

The loader 10 possesses a hydraulic source 28 and a hydraulic tank 30, which are arranged underneath the vehicle bodywork and serve the purpose of supplying the hydraulic components.

An operating device 34, in the form of a hydro-mechanical joystick, is arranged in a cab 32 and serves the purpose of actuating the hydraulic components. The hydraulic components are illustrated substantially in FIG. 2.

Figure 2:
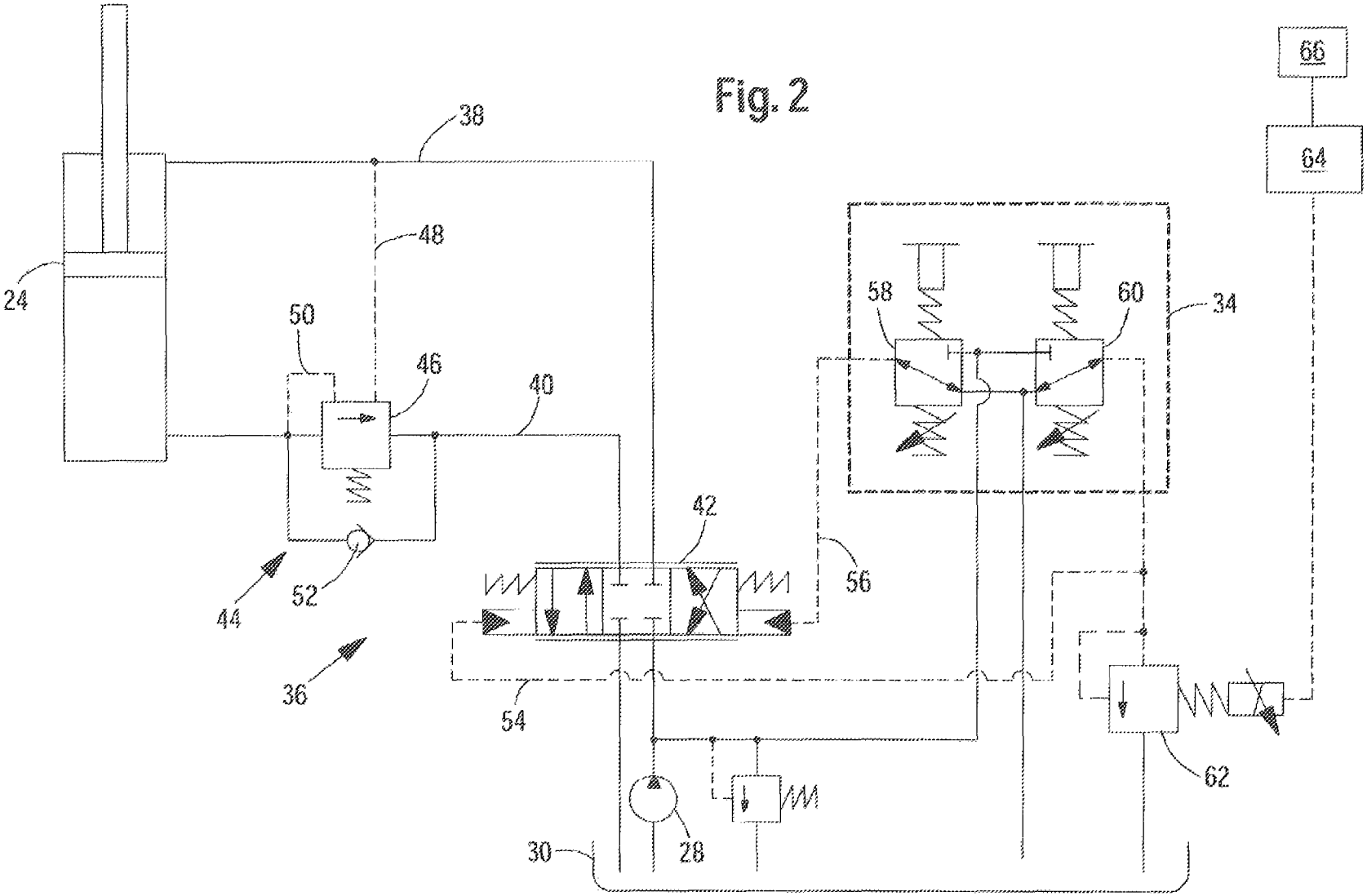
FIG. 2 is a schematic circuit diagram of a hydraulic arrangement.

A hydraulic arrangement 36 envisaged for the loader 10 is illustrated in FIG. 2. The hydraulic arrangement 36 comprises the hydraulic cylinder 24 and, should the need arise, the hydraulic cylinders (not illustrated) arranged for the telescoping of the extension arm 14 and tilting of the loading implement 26 the hydraulic cylinder 24 is connected via first and second supply lines 38 and 40, respectively, to a hydraulically actuated control device 42, via which the connection of the supply lines 38, 40 to the hydraulic pump 28 and the hydraulic tank 30 can be produced.

A load holding valve 44 is arranged in the supply line 40 associated with the chamber on the lifting side of the hydraulic cylinder 24. The load holding valve comprises a pressure-limiting valve 46 capable of being opened via control pressure lines 48, 50, which are connected to both supply lines 38, 40, as well as a check valve 52 arranged in a bypass line and opening in the direction of the hydraulic cylinder 24. The load holding valve 44 serves to ensure that, in the event of a pipe fracture on the lifting side of the hydraulic cylinder 24, no hydraulic fluid is able to escape and the hydraulic cylinder 24 maintains its position.

The control device 42 comprises three gate positions, one for lifting, one for lowering and one more for holding the hydraulic cylinders. The control device 42 is configured as a hydraulically actuated proportional valve and can be hydraulically actuated or adjusted via corresponding control pressure lines 54, 56. The control pressure in this case is generated by the hydro-mechanical operating device 34, which is executed as a joystick.

The operating device 34 possesses valves 58, 60 that are actuated mechanically, for example, by moving the joystick, which provides for the engagement or disengagement of the hydraulic pump 28 with or from the control pressure lines 54, 56. The mechanically actuated valves 58, 60 are preferably configured as pressure reduction valves. For example, a joystick or actuating lever present Oh the operating device 34 is pushed forwards, which results in the actuation of the valve 58. The control pressure line 56 is then subjected to a hydraulic pressure produced by the hydraulic pump 28, whereupon the control device 42 is displaced into its lifting position and the hydraulic cylinder 24 is filled with hydraulic fluid on the lifting side, that is to say it is extended. A corresponding actuation of the actuating lever in the opposite direction would cause actuation of the valve 60, whereupon the control pressure line 54 would be filled with hydraulic fluid and the control device 42 would be displaced into the lowering position, that is to say the hydraulic cylinder 24 would be retracted.

In the illustrative embodiment depicted in FIG. 2, the control pressure line 54 is provided with an electro-hydraulic overpressure valve 62 connected to the hydraulic tank 30. The overpressure valve 62 causes the control pressure prevailing in the control pressure line 54 to be reduced. In the event of a pre-set limit pressure being reached or exceeded by the control pressure, the overpressure valve 62 opens increasingly so that an increasing quantity of hydraulic fluid flows into the hydraulic tank 30, with the result that the displacement of the control device 42 is reduced by the control pressure line 54 and, as a result, the actuation of the hydraulic cylinder 24, in this case the retraction of the hydraulic cylinder 24, is slowed down. Of course, the other control pressure line 56 can also be connected to an overpressure valve 62 of this kind. In this case, extension of the hydraulic cylinder 24 would then be slowed down.

Control of the overpressure valve 62 takes place through the electronic control unit 64, which for its part receives control signals from the load case sensor 66. Depending on the load condition, the sensor indicates a more or less critical load condition. As the critical load condition is approached, the control input transmitted by the electronic control unit 64 for adjusting the overpressure valve 62 is also strengthened, which then causes the valve to be increasingly opened, so that hydraulic fluid flows increasingly from the control pressure line 54 and the control pressure is reduced. The adjustment or the increase of the control input in this case preferably takes place proportionally to the signal provided by the sensor.

The load sensor 66 is preferably arranged on the rear axle 18 of the loader 10. For example, the sensor 66 is configured as a strain gauge and registers or records the deflection of the rear axle 18. It is then possible to arrive at a conclusion in respect of the application and removal of the load on the rear axle 18 from the signal values for the deflection. If the load on the rear axle 18 were to reduce increasingly, this can point to the existence of a critical load condition, namely at the latest if a load was no longer to be detected or indicated on the rear axle 18. In this case, the loader 10 begins to overturn. A similar approach is also conceivable for the front axle 16.

The illustrative embodiment depicted in FIG. 2 provides a representative indication of the arrangement of only a single hydraulic cylinder 24. As mentioned above, further hydraulic cylinders (not illustrated) can be used in parallel, which cylinders are capable of actuation in the same way as an actuating device 34 and are incorporated in a hydraulic arrangement 36 of the kind depicted in FIG. 2.

Furthermore, it is possible not only to restrict and/or to slow down the retraction of the hydraulic cylinder 24. It is naturally also conceivable to restrict and/or slow down the extension, as would be required, for example, in order to avoid the extension of the extension arm 14 to prevent overturning of the telescopic loader. In this case, the control pressure line 56, with which the lifting position of the control device 42 and with it the extension of the hydraulic cylinder 24 is actuated, would be provided with or connected to an electro-hydraulic overpressure valve 62.

Figure 2A:
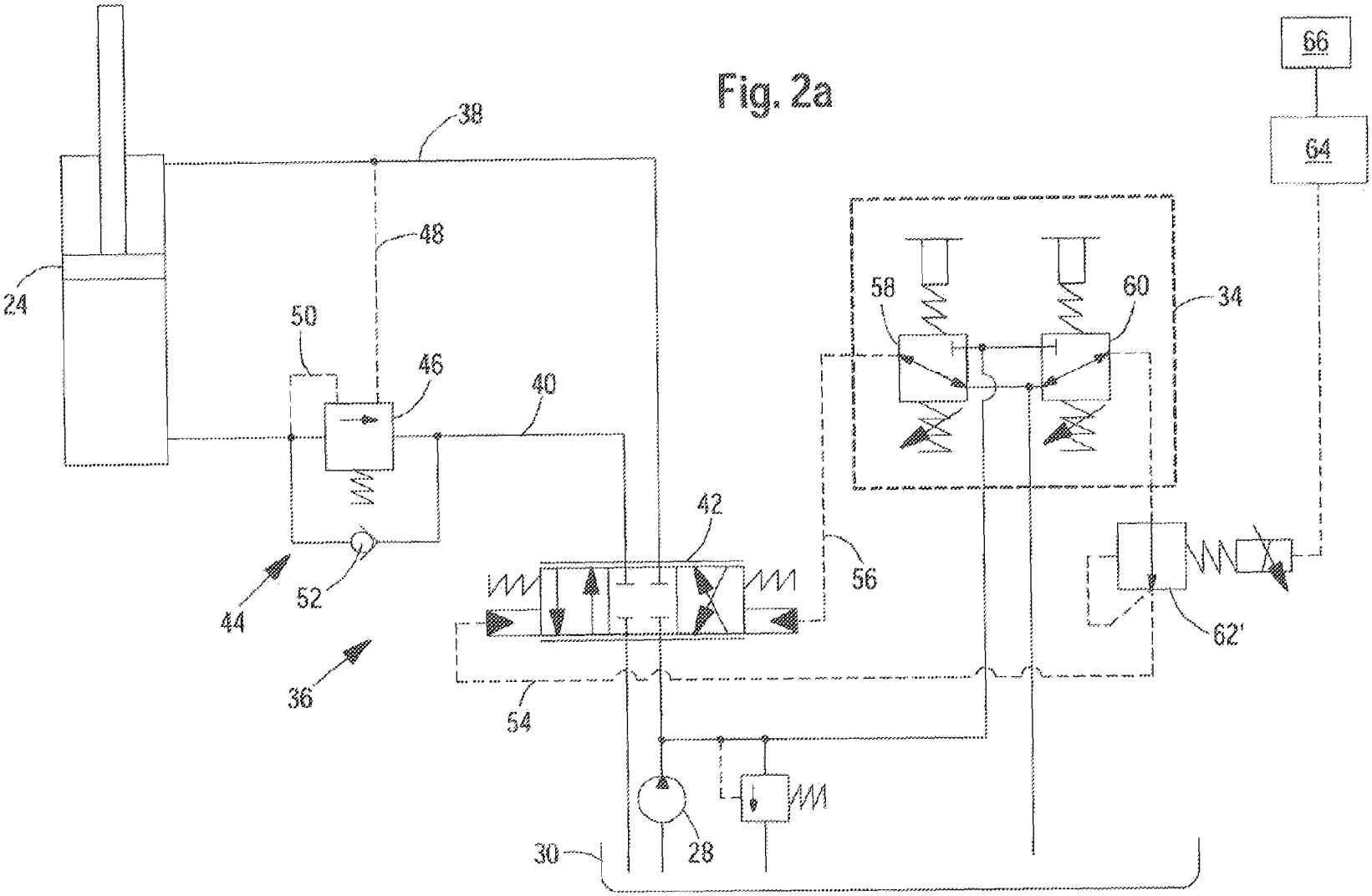
FIG. 2*a* is a schematic circuit diagram of an alternate embodiment of the hydraulic arrangement of FIG. 2.

FIG. 2*a* depicts an alternate illustrative embodiment of the hydraulic arrangement, in which the control pressure line 54 is provided with an electro-hydraulic pressure reducing valve 62', in conjunction with which the connecting line to the hydraulic tank 30, which is provided in the illustrative example for FIG. 2, is omitted. Here, too, the pressure reduction valve 62' causes the control pressure prevailing in the control pressure line 54 to be reduced or throttled. If a pre-set limit pressure is reached or exceeded by the control pressure, the pressure reduction valve 62' closes so that the control pressure in the control pressure line 54 is reduced or throttled. If a pre-set limit pressure is reached or exceeded by the control pressure, the pressure reduction valve 62' closes so that the control pressure in the control pressure line 54 reduces, with the result that the displacement of the control device 42 is reduced by the control pressure line 54 and, as a result, the actuation of the hydraulic cylinder 24, in this case the retraction of the hydraulic cylinder 24, is slowed down. Of course, the other control pressure line 56 can also be connected to a pressure reducing valve 62' of this kind. In this case, extension of the hydraulic cylinder 24 would then be slowed down.

Here, too, control of the overpressure valve takes place through the electronic control unit 64, which for its part receives control signals from a load case sensor 66. Depending on the load condition, the sensor 66 indicates a more or less critical load condition. As the critical load condition is approached, the control input transmitted by the electronic control unit 64 for adjusting the pressure reduction valve 62' is also strengthened, which valve is then closed increasingly, so that the control pressure reduces. The adjustment for the increase of the control input in this case preferably takes place proportionally to the signal provided by the sensor.

The load sensor 66 is preferably also located on the rear axle 18 of the loader 10, in this case too, and is configured in an analogous manner to the illustrative embodiment depicted in FIG. 2.

The illustrative embodiment depicted in FIG. 2*a* also provides a representative indication of the arrangement of only a single hydraulic cylinder 24. In this case, too, further hydraulic cylinders (not illustrated) can be used in parallel, which cylinders are capable of actuation in the same way as an actuating device 34 and are also incorporated in a hydraulic arrangement 36 of the kind depicted in FIG. 2*a*.

Furthermore, it is possible not only to restrict and/or to slow down the extension, as would be required, for example, in order to avoid the extension of the extension arm 14 to prevent overturning of the telescopic loader. In this case, the control pressure line 56, with which the lifting position of the control device 42 and with it the extension of the hydraulic cylinder 24 is actuated, would be provided with or connected to an electro-hydraulic pressure reduction valve 62'.

Figure 3:
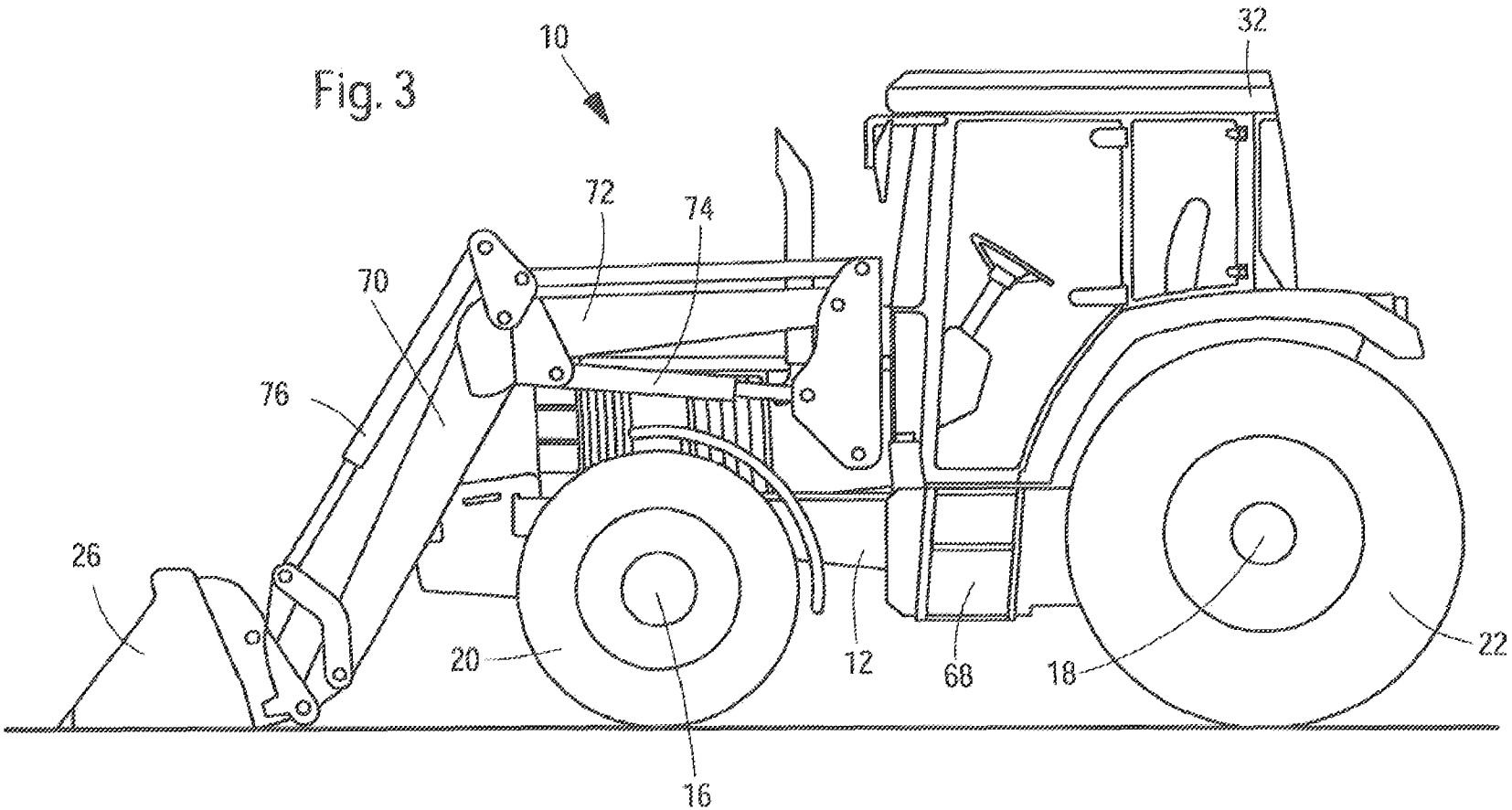
FIG. 3 is a schematic left side view of a loader exhibiting a front loader having a hydraulic arrangement.

FIG. 3 depicts a loader 10 in the form of a tractor 68 with a front loader 70 as a further illustrative embodiment, in conjunction with which the same reference designations are used for the same components of the loaders 10, such as the frame 12, front axle 16, rear axle 18, wheels 20, 22, loading implement 26 and cab 32.

In this case, the load arms 72, which are arranged to either side of the tractor 68, represent an extension arm, the actuation of which in specific situations and in the event of overloading can give rise to critical load conditions of the loader 10.

The hydraulic cylinders 74 provided for the actuation of the load arms 72 and the hydraulic cylinders 76 provided for the actuation of the loader implement 26 are operated in this case in an analogous manner to the hydraulic arrangement 36 depicted in FIG. 2.

Having described the preferred embodiment, it will become apparent that various modifications can be made without departing from the scope of the invention as defined in the accompanying claims.

The invention claimed is:

1. In a loader including a frame supported on front and rear axles carrying front and rear sets of wheels, a hydraulically operated extension arm mounted to the frame for swinging vertically between lowered and raised positions, an extensible and retractable hydraulic cylinder coupled between said frame and said extension arm for selectively moving said arm between said lowered and raised positions, a first supply line coupled to a piston rod side of said hydraulic cylinder, a second supply line coupled to a piston side of said hydraulic cylinder, a pressurized hydraulic fluid source, a hydraulic fluid tank, at least one hydraulically switchable control device coupled, on the one hand, to said first and second supply lines and coupled, on the other hand, to said fluid source and fluid tank, a hydro-mechanical actuating device being coupled to said fluid source and said fluid tank and being coupled and selectively operable for routing a control pressure to said control device via first and second control pressure lines, so as to effect actuation of said control device for controlling the flow of hydraulic fluid to and from said hydraulic cylinder, a load sensor located on said loader for monitoring a load condition on the loader and operable for creating an electrical load signal representing said load condition, and an electronic control unit coupled to said load sensor for receiving said electrical load signal and comparing it with a critical load stored in memory in said electronic control unit and for generating a control signal representing a difference between said load signal and said critical load, the improvement comprising: said control device being a proportional valve mounted for movement in opposite directions from a centered hold position, wherein the flow of fluid to and from said fluid supply lines is blocked, respectively to a lift position wherein said fluid source is connected to said first supply line while said tank is connected to said second supply line, and to a lower position wherein said tank is connected to said first supply line while said fluid source is connected to said second supply line; an electrically operable electro-hydraulic over pressure valve being coupled to one of said control pressure lines at a location downstream from said hydro-mechanical actuating device, and further being coupled to said electronic control unit for receiving said control signal whereby said electro-hydraulic over-pressure valve is operated in accordance with said control signal so as to effect changes in the pressure contained in said one of said control pressure lines so that said proportional valve acts to slow movement of said hydraulic cylinder in a direction causing an increase in said load signal.

2. The loader, as defined in claim 1, wherein said actuating device includes one of a joystick or actuating lever.

3. The loader, as defined in claim 1, wherein said loader is a telescopic loader.

4. The loader, as defined in claim 1, wherein said loader is a front loader.

5. The loader, as defined in claim 1, wherein said load sensor is arranged on one of said front and rear axles.

* * * * *